US005687459A

United States Patent [19]

Vanmoor

[11] Patent Number: 5,687,459

[45] Date of Patent: Nov. 18, 1997

[54] LABEL AGAINST SHOPLIFTING OF GARMENTS

[76] Inventor: Arthur Vanmoor, 18761 W. Dixie Hgwy #209, N. Miami Beach, Fla. 33180

[21] Appl. No.: 378,381

[22] Filed: Jan. 6, 1995

[30] Foreign Application Priority Data

Jul. 9, 1992 [NL] Netherlands ..... 9201231
Jul. 28, 1994 [NL] Netherlands ..... 9401250

[51] Int. Cl.[6] ..... A44B 9/00

[52] U.S. Cl. ..... 24/704.1; 24/5; 24/703.1; 24/456

[58] Field of Search ..... 24/704.1, 703.1, 24/572, 456, 104, 5, 710.5; 70/57.1

[56] References Cited

U.S. PATENT DOCUMENTS

| | | | |
|---|---|---|---|
| 2,089,221 | 8/1937 | Patur et al. | 24/5 |
| 2,749,588 | 6/1956 | Pliszczak et al. | 24/104 |
| 4,052,771 | 10/1977 | Cole | 24/104 |
| 4,483,049 | 11/1984 | Gustavsson et al. | 70/57.1 |
| 4,559,675 | 12/1985 | Devenny | 24/5 |
| 4,649,397 | 3/1987 | Heaton et al. | 70/57.1 |
| 4,745,664 | 5/1988 | Damvig | 24/704.1 |
| 4,841,604 | 6/1989 | Stevens | 24/704.1 |

FOREIGN PATENT DOCUMENTS

| | | | |
|---|---|---|---|
| 0575001 | 4/1959 | Canada | 24/704.1 |
| 2453641 | 11/1980 | France | 24/704.1 |

*Primary Examiner*—Victor N. Sakran
*Attorney, Agent, or Firm*—Herbert L. Lerner; Laurence A. Greenberg

[57] ABSTRACT

A device for temporary attachment to goods having a flexible material for the protection thereof against theft. The device includes a side with a recess formed therein, the recess having a given shape. The recess is bounded laterally by undercut side walls. A part having a shape substantially complementary to the recess of the member and being adapted to be inserted in the recess. The recess of the member and the part defining a space therebetween for receiving and clamping a layer of flexible material of the goods to be protected against theft without penetrating through the flexible material. The recess and the part are provide with mutually cooperating means for releasably locking the part in the recess of the member with the layer of material clasped in between.

7 Claims, 15 Drawing Sheets

LABEL AGAINST SHOPLIFTING OF GARMENTS

BACKGROUND AND FIELD OF THE INVENTION

The invention relates to labels for theft protection.

The a label of the invention can be attached easily and fast to garments or cloth, or any other product, which have to be protected, and which label can be removed easily and fast by personnel, without traces or damage. The label is reusable.

The label has several embodiments and corresponding uses:

1. The label as ordinary label, without further built-in equipment;
2. The label provided with equipment, which in conjunction with further equipment brings about an alarm signal when the label, thus with stolen garments, threatens to leave the shop; for example, a coil in conjunction with an antenna near the exit;
3. the label can be attached to a secured chain;
4. the label is provided with a capsule with ink or acid, which bursts when the thief tries to detach the label.

A well assorted shop will prefer a combination. For example, with underpants type 1, with sweaters type 2, with leather coats type 3, on garments displayed outside type 4.

Many security labels are known and come with their specific draw-backs. Existing labels are produced as type 2, type 4, or a combination of type 2 and type 4.

It is important that security labels when attached to garments, can carry the weight of a chain, at least without tearing the cloth. Furthermore, security labels must be strong enough to resist, once stolen, the manual power of the shoplifter.

The label provided with a coil has become a classic. One member of the label contains a 1.2 mm thick pin, the other member of the label comprises a hole, in which the pin is clasped by a jaw mechanism. The pin punctures the garment. Such label can be shielded with aluminium foil which prevents detection and putting the alarm equipment into action. Two labels flat against each other also prevent detection.

Labels exclusively with ink should serve a precautionary purpose. It turned out that this does not always work, or only for cheap articles which are roughly as expensive as the label itself. Several labels comprise a combination of ink and signalization. The label of Custavsson U.S. Pat. No. 4,483,049 with a built-in coil according to Heaton U.S. Pat. No. 4,649,397, has the following drawbacks: It can only be attached to the edge of the cloth and may, consequently, be cut out easily. It takes new personnel one day to learn how to unlock this label. It can be shielded from detection manually. It is expensive.

Hogan's label U.S. Pat. No. 5,054,172 has some drawbacks. The pin is rough and may puncture thin cloth. When a shoplifter unfamiliar with this label tries to remove the label, ink is spilled over the garment; the shoplifter will disappear undisturbed, leaving the garment behind useless. After this the label, too, is rendered useless.

The advantages of the present invention are that it leaves no punctures, it can be too large to cut out or to shield and it is impossible for the thief to remove when produced from sturdy material—, it is also easy to manufacture and thus inexpensive.

Several embodiments of the invention will be described in the following

BRIEF DESCRIPTION OF THE DRAWING

FIG. 17 is a sectional view of an embodiment in which a coin-like member is slid into a groove with the cloth in between;

FIG. 33*b* is a view of the member according to arrow 21 of FIG. 32*a;*

DESCRIPTION OF THE PREFERRED EMBODIMENT

Figure 1:
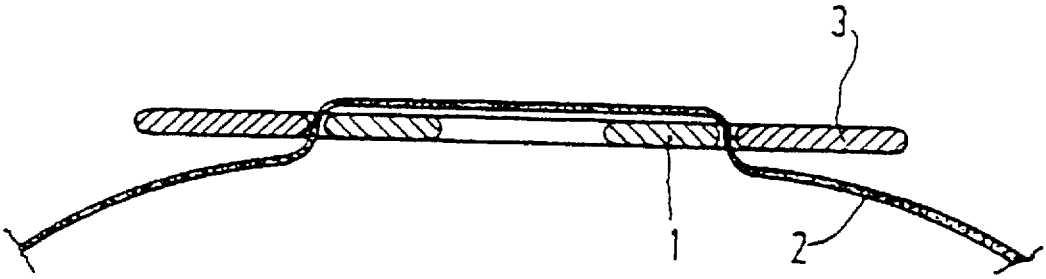
FIG. 1 is a cross-sectional view of two members with a garment.
Figure 2:
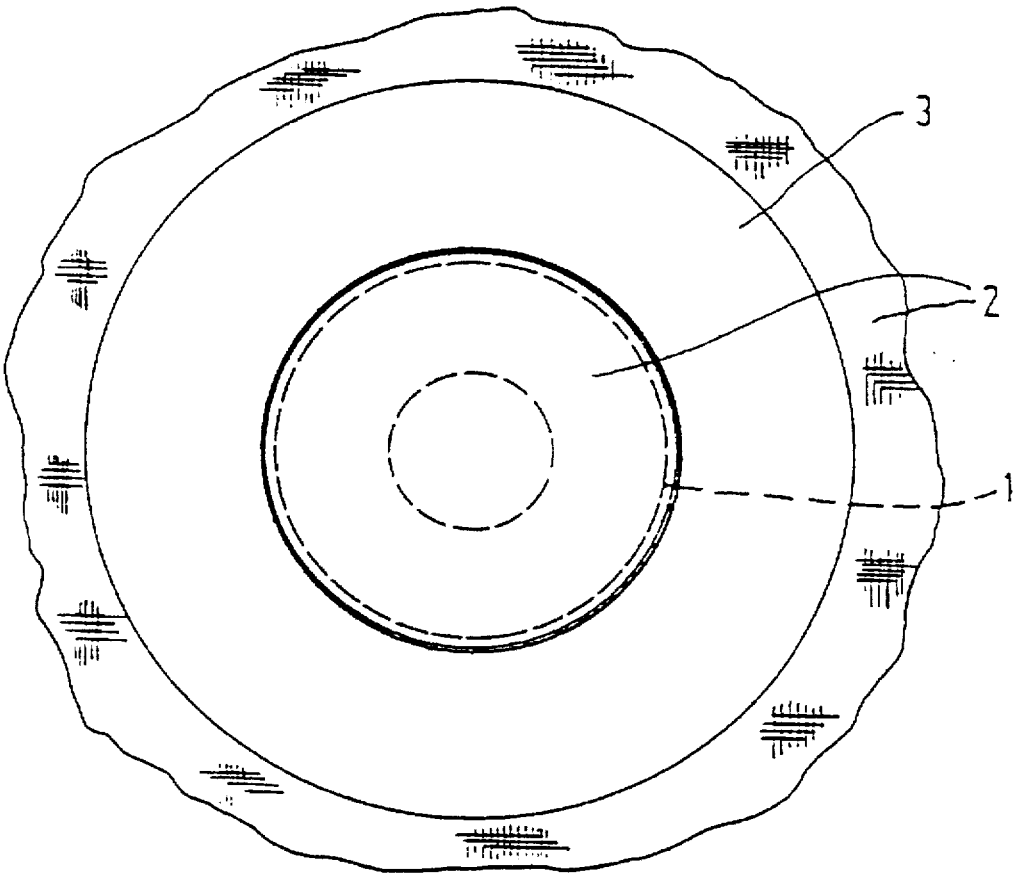
FIG. 2 is a top view of a label.
Figure 3:
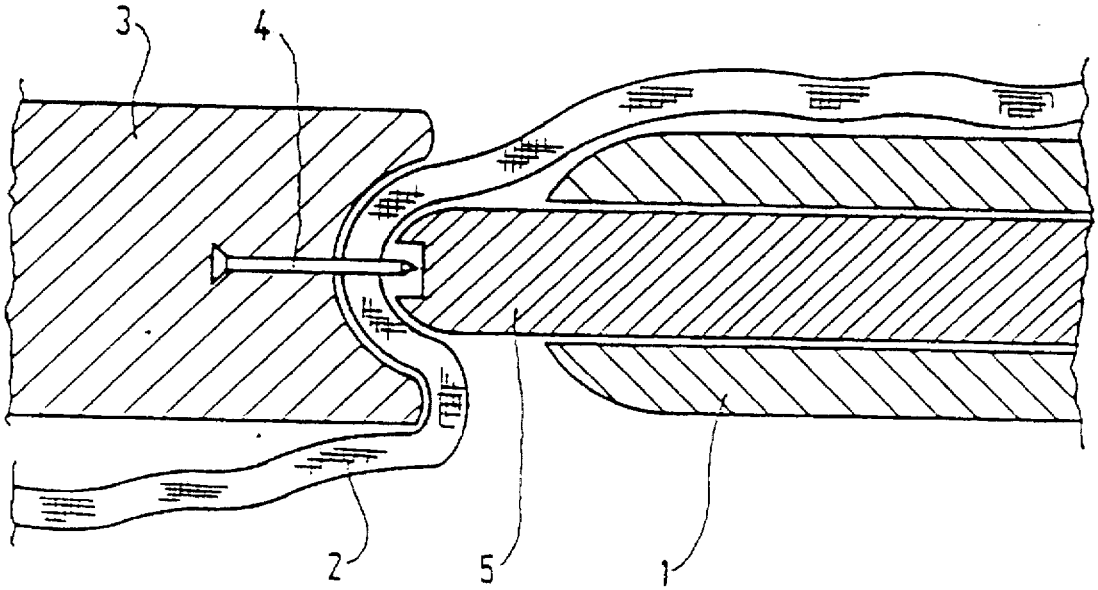
FIGS. 3 and 4 are cross sectional views of a securing mechanism.
Figure 4:
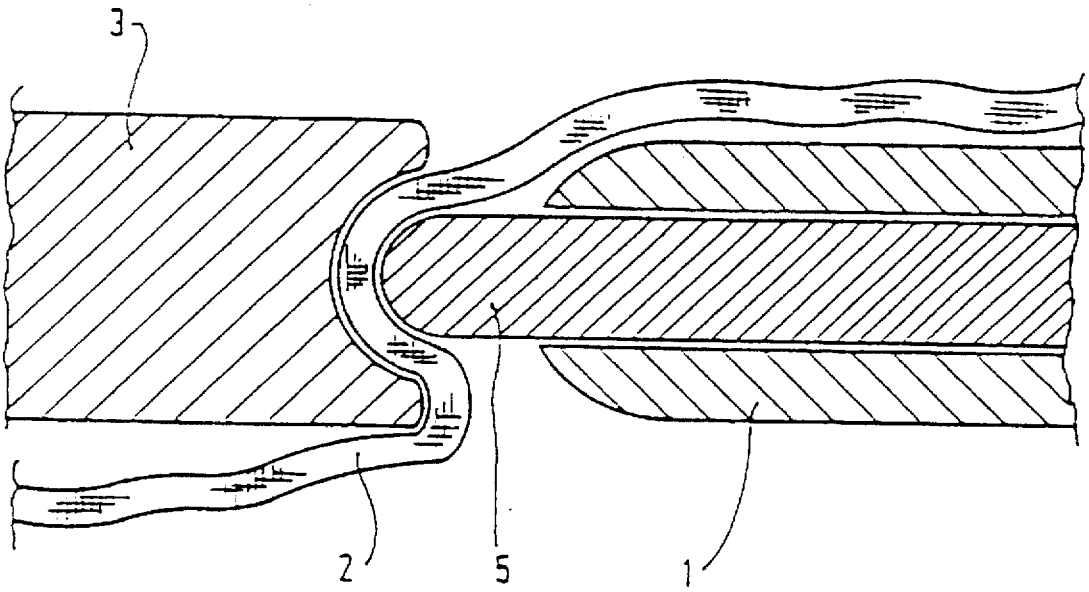
Figure 5:
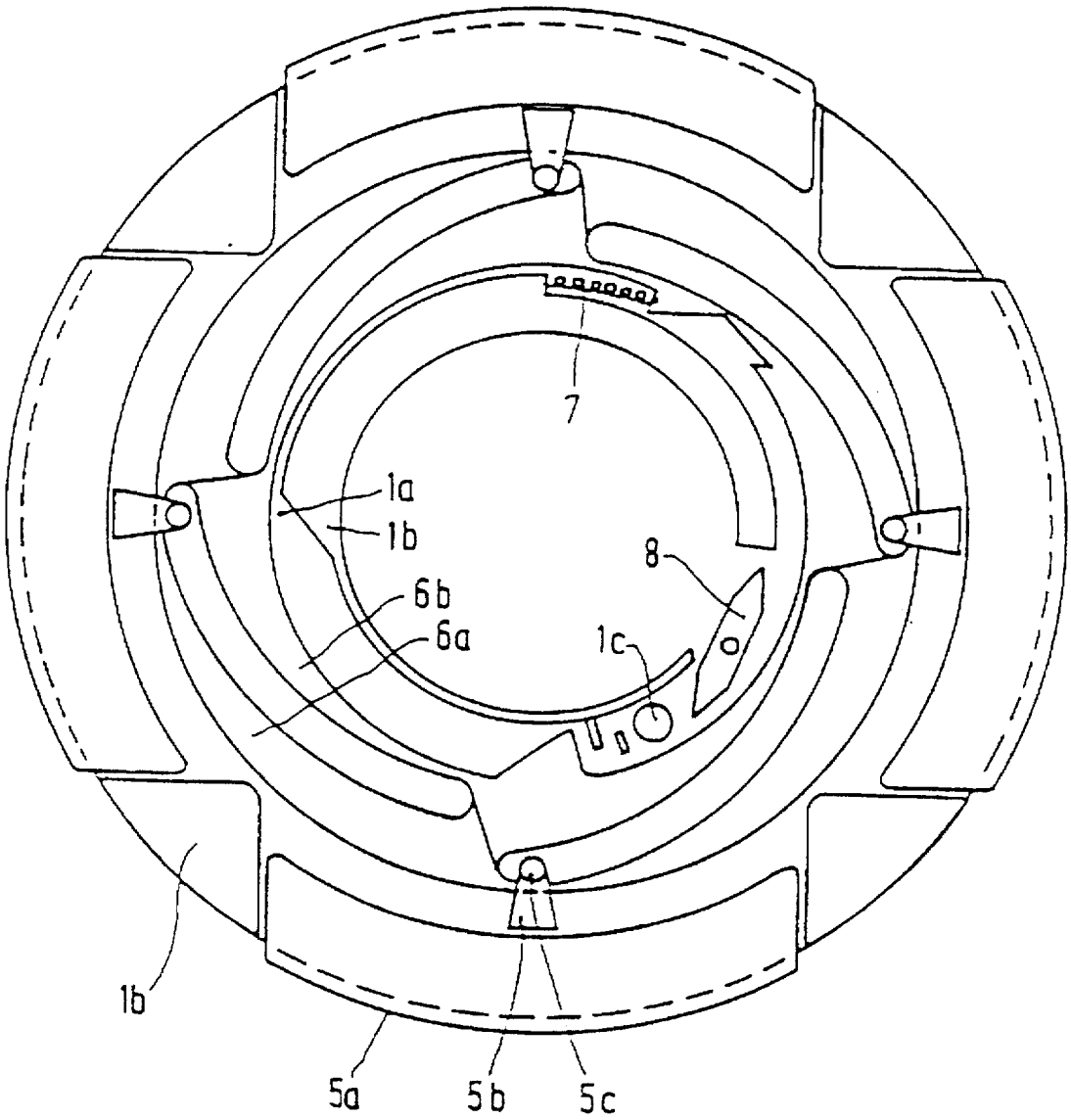
FIG. 5 is a plan view of inner workings of the label seen from above.

The device comprises two substantially flat members, the first member fits into the second member. FIG. 1 shows a cross-sectional view of the two members with garment; FIG. 2 B shows a top view of the label. In the installed position the cloth covers the first part and has thus two S-curves. The disc shaped members lie exactly in a plane. Therefore the different embodiments of the two members may secure the cloth there where the cloth has S-curves. FIGS. 3 and 4 show in a cross sectional view the securing mechanism. The inner member is provided with a tongue which can protrude from the inner member. The outer part has in the inner edge a complementary receiving gap. The construction eliminates the need for needles or pins. This label is, for example, suited for plastic raincoats or leather clothing. In this embodiment the tongue exerts enough pressure on the cloth to prevent the shoplifter from pulling the cloth free. FIG. 3 shows the same as FIG. 4 but here numerous very small needle tips are mounted in the gap, and the tongue is provided over the full circumferential length, with a narrow groove. The groove has a width which is sufficient to prevent the occurrence of forces in case a shoplifter levers the label. Provided the label, including the tongue, is manufactured of hard material, such as PVC, then it will be impossible for a thief to remove the label. Weight does not play an important part, thus this label can be fairly large to prevent shielding. If a coil is used, it may be anywhere on the outside edge. The old trick of shoplifters to place two labels with the coils against each other, which prevents detection, would not work, because with the label according to the invention the shoplifter does not know where the coil resides in the label, so this trick would only work by chance. FIG. 5 shows the inner workings of the label seen from above. The tongues are moved by a rotatable ring with slots in which a part of the tongue catches. The slots are not concentric. Rotation makes the slots work as wedges and the tongues will go in and out.

Forces on the tongue cannot move the ring. A spring arranges that the ring is in a position with the tongues "out". Air may be introduced via a hole with a kind of airgun making the ring turn and snapping a catch in an opening. The entity is then in a resting position and the label can be detached, stored and again attached to a garment. The catch is constructed in such a way that in the said position a part protrudes from the inner edge. Personnel desiring to attach a label can do this without equipment, by placing one member on a table, putting the cloth over it, and subsequently the other member. The members lie in one plane and always fit. If the catch is pressed the tongues will project into the second member and the label is attached in a shoplifting-resisting position. We expect the thief not to possess a suitable airgun. To prevent the thief from using iron wire to turn the ring, blocking means have been provided to prevent this.

Figure 6:
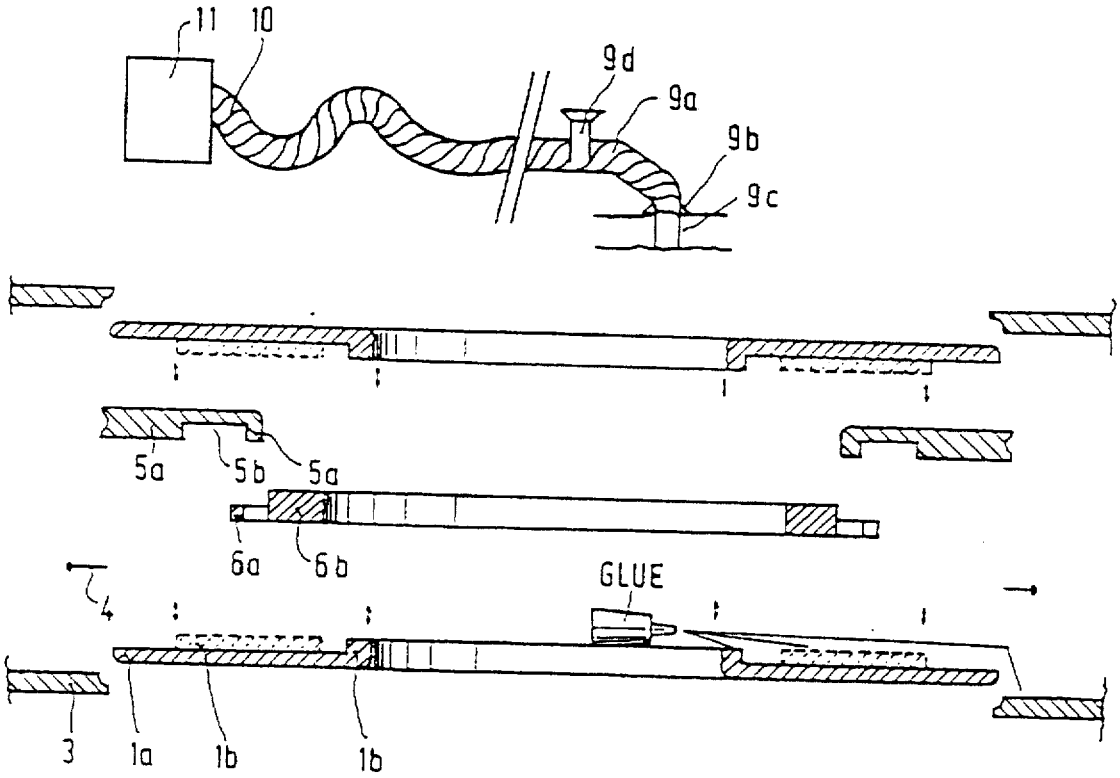
FIG. 6 is a longitudinal cross section of a label as well as an airgun.

FIG. 6 shows a longitudinal cross section as well as the airgun. The airgun is provided with a switch which allows air to pass only in a depressed position of the switch. The end of the airgun is closed. Air is ejected sideways. Projecting means ensure that the holes enter the label at the right position. The label has two holes, and the gun ensures that the other hole is blocked.

Figure 7:
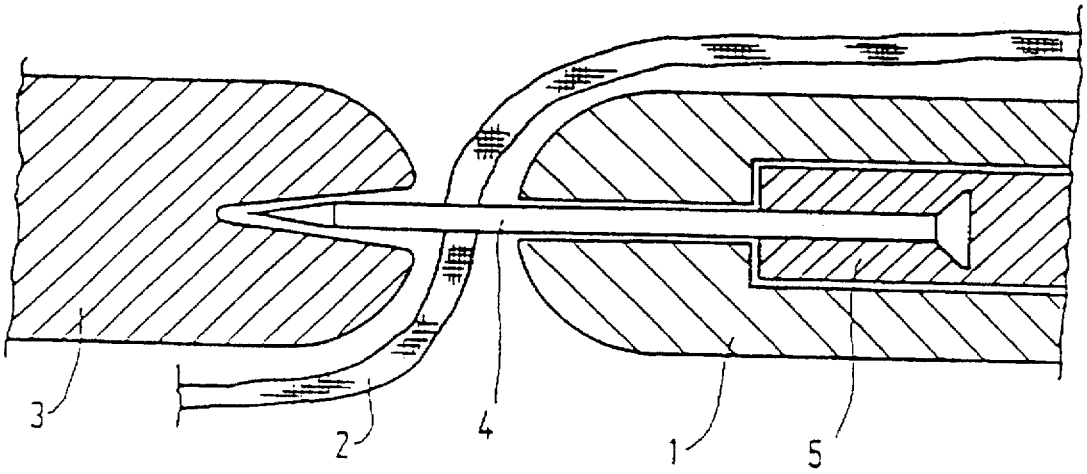
FIGS. 7 and 8 are cross sectional views of alternative embodiments of the construction between discs.
Figure 8:
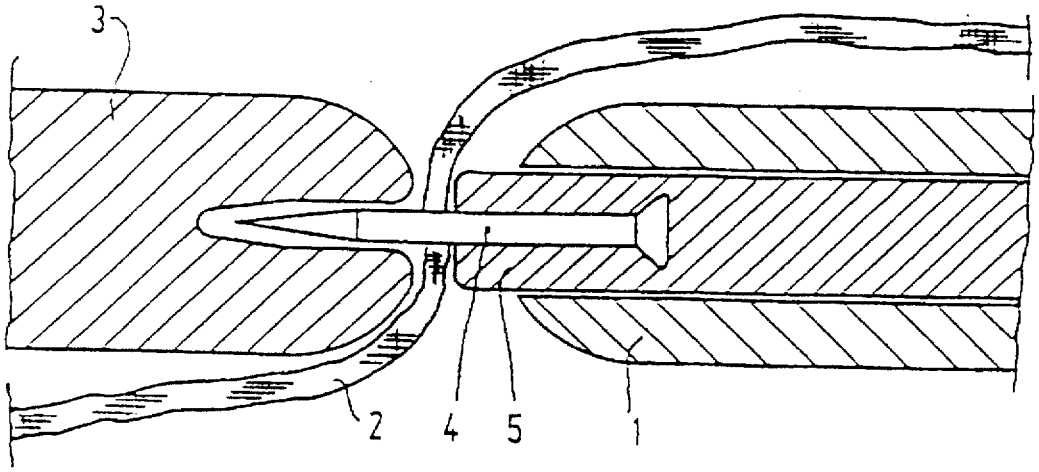

FIG. 7 and 8 show an alternative embodiment of the construction between the discs. Here the cloth is bent less, thus making a less crumpled impression. In case of levering there will be forces on the needles. As the needles are near the opening in which they are received, and therefore only free over the thickness of the cloth, there will be a considerable force necessary to bend or break the needles. If the working point and the supporting point are 1 mm from each other, a needle with a thickness of 0.5 mm can resist a 10 kg force. With twelve needles distributed over the circumference the shoplifter will have to be able to exert a 60 kg force on one side with his thumbs, which is unlikely.

Figure 9:
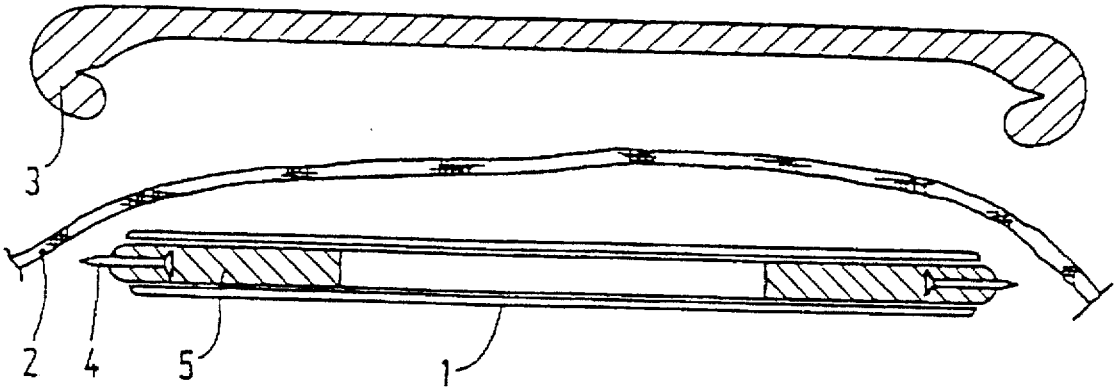
FIG. 9 is another embodiment in cross-sectional view.

FIG. 9 shows another embodiment in cross-sectional view. Here the larger second disc is replaced by a disc which is slightly larger than the inner disc. The outer disc has an edge which has been bent back over 180 degrees.

Figure 10:
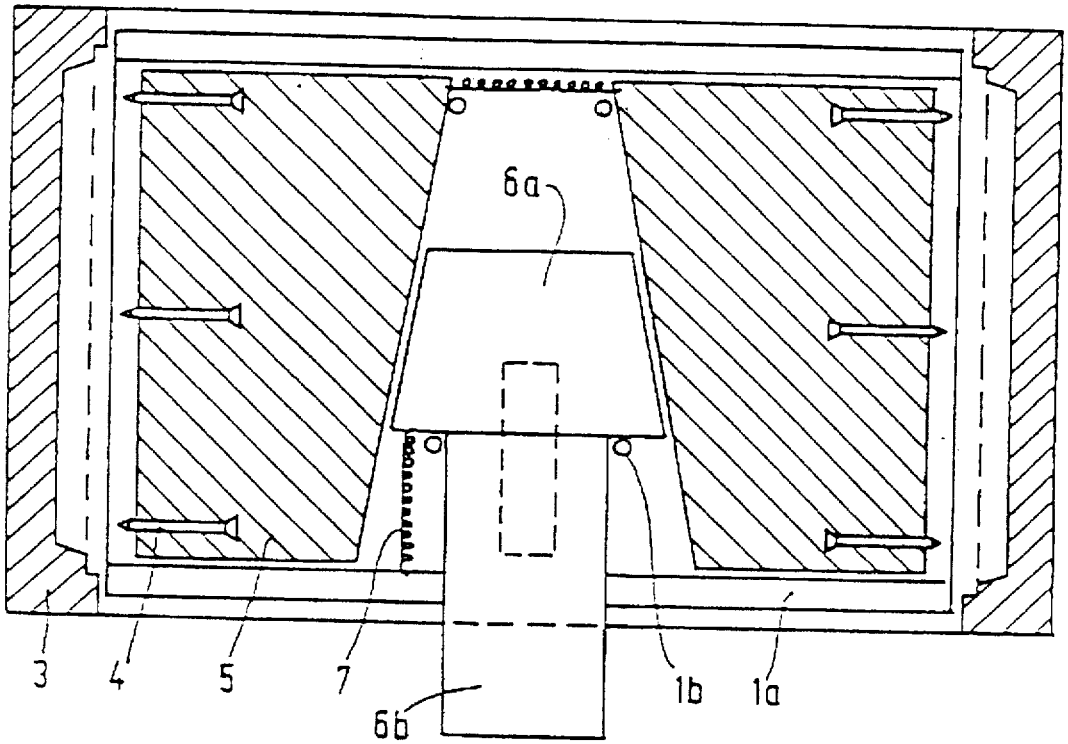
FIG. 10 is a sectional view of an embodiment which is not circular.
Figure 11:
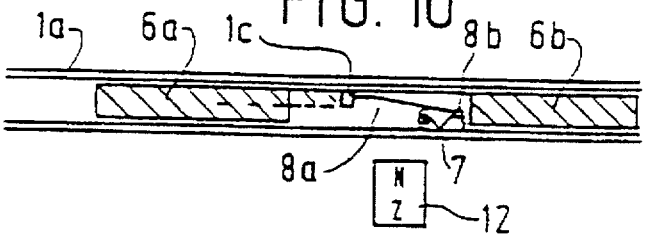
FIG. 11 is a sectional view of a catch.

FIG. 10 shows an embodiment which is not circular. Also in this case a choice can be made from the four securing mechanisms C, D, G or H. In this embodiment the reverse side of the tongues have the form of a wedge. A member can slide against these reverse sides to move the tongues in and out. In the unlocked position of the label the member protrudes. While pushing this member to the interior, the cloth between the discs will be secured. The protruding member is now completely in the label and can only be released if the built-in catch is disengaged. This may be achieved by the shop personnel with a powerful electric magnet. A first spring ensures that the member comes out and a second spring retracts the tongues. FIG. 11 shows the catch which, in case a magnet is used, should be made of iron. The catch snaps under action of a spring in a specially made notch.

Figure 12:
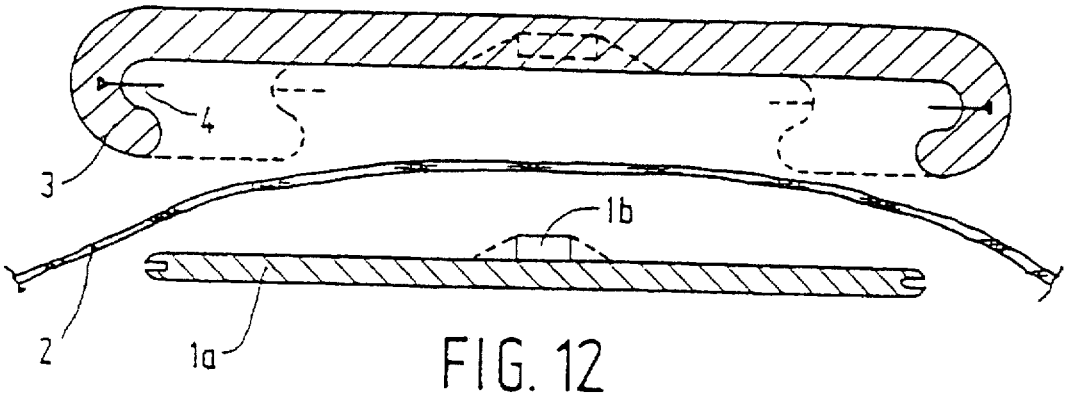
FIG. 12 is a view similar to FIG. 9 of a simple but effective embodiment.
Figure 13:
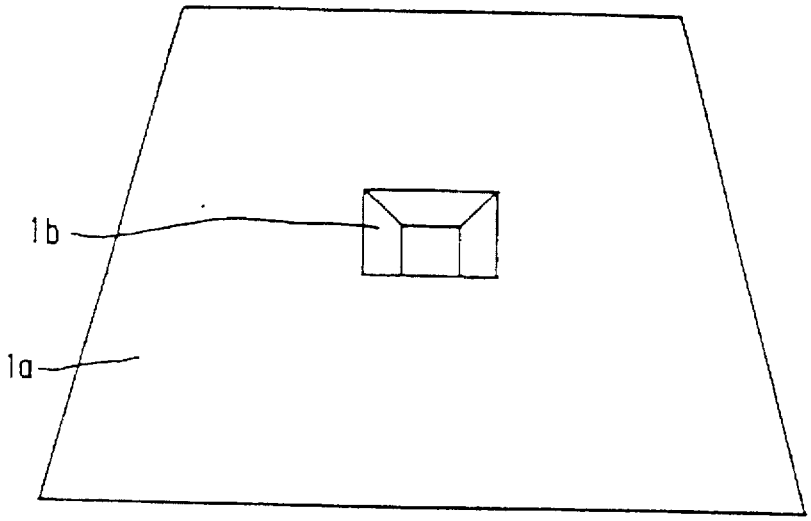
FIG. 13 is an elevational view showing that the inner part possesses two oblique edges.
Figure 14:
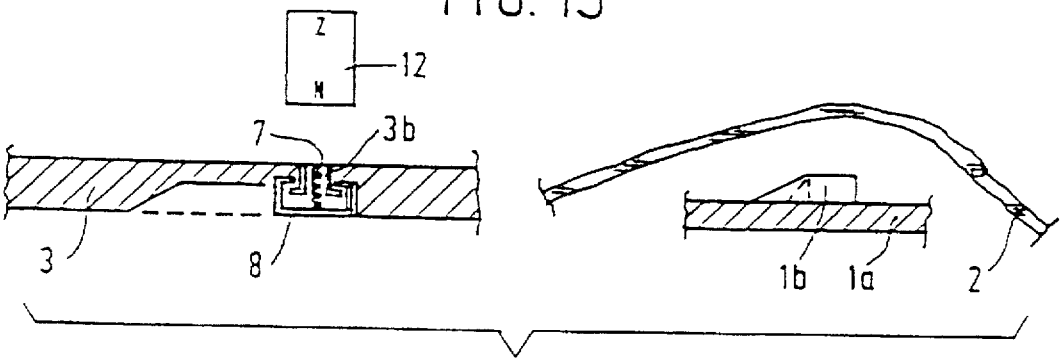
FIG. 14 is a partial sectional view thereof.

FIG. 12 shows a simple but effective embodiment. From FIG. 13 it can be seen that the inner part possesses two oblique edges. In this embodiment no tongues and wedges are used. The personnel should slide the two parts with cloth in between into each other during attachment of the label. In the first part there is a notch in which a bulge may be engaged. Before this notch there is a part that can be depressed slightly by the bulge during assembly. The shoplifter has no way to slide the label back. Personnel can, with an apparatus, for example a magnet, retract the part near the notch and thus detach the label.

Figure 15:
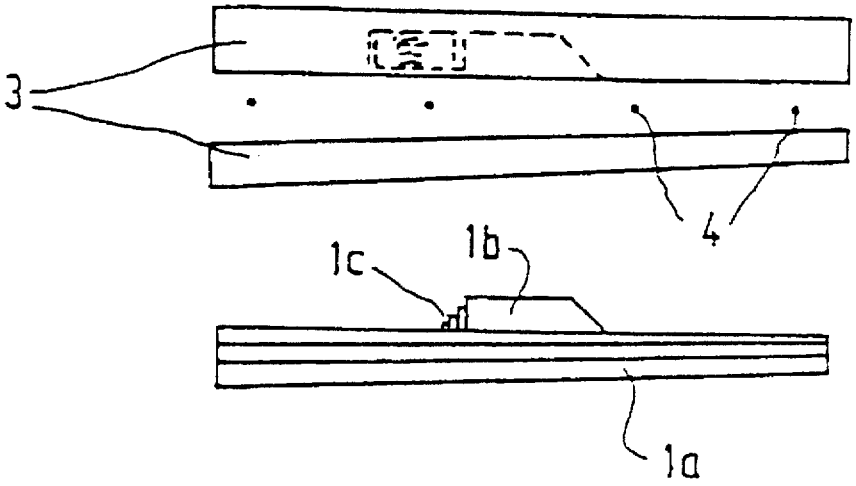
FIG. 15 is an elevational view showing the possibility to make the groove in the securing jaw, as well as the inner part, slightly tapered.
Figure 16:
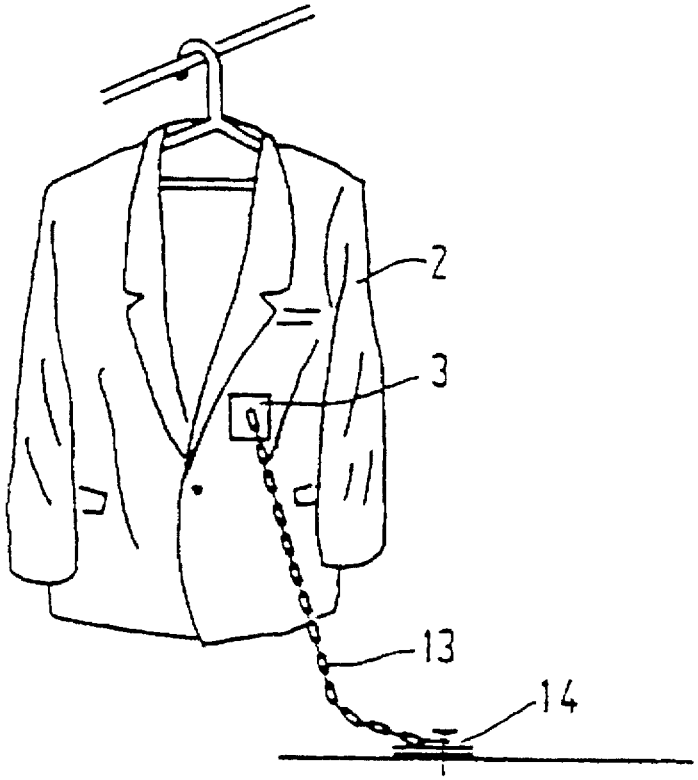
FIG. 16 is an elevational view of a garment protected by a label provided with a chain.

FIG. 15 shows the possibility to make the groove in the securing jaw, as well as the inner part, slightly tapered. The back of the bulge is serrated. In this way the label is attached optimally with any cloth thickness. FIG. 16 shows a garment protected by a label provided with a chain. The chain is secured to the floor.

Figure 17:
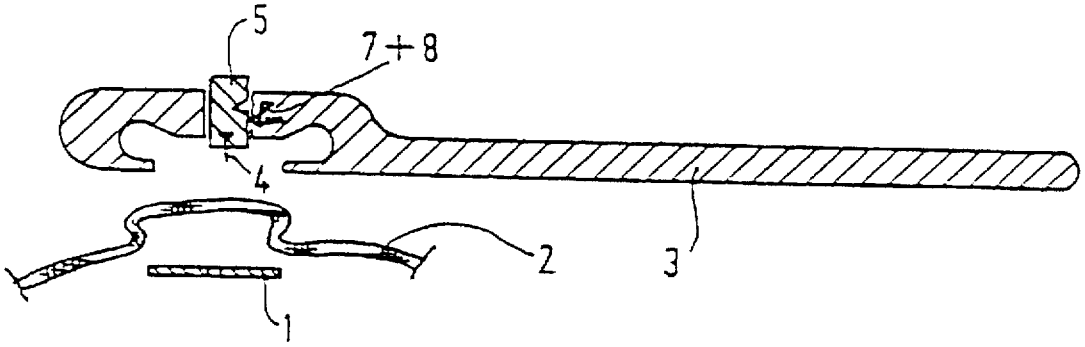
Figure 18:
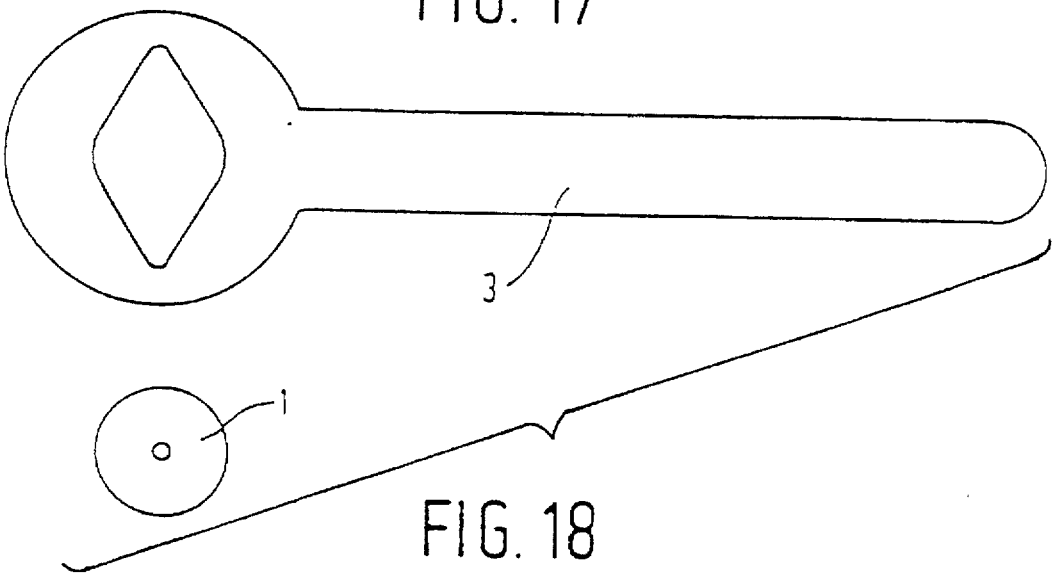
FIG. 18 is a plan view of the label from below.
Figure 19:
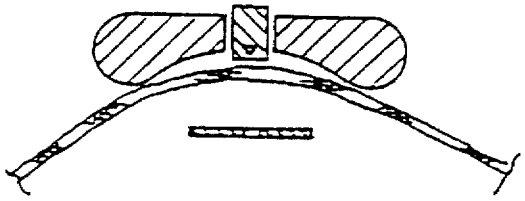
FIG. 19 is a cross section of the front side.

FIG. 17 shows an embodiment in which a coin-like member is slid into a groove with the cloth in between. A push button is pressed from the other side against the coin with cloth. Now the coin with cloth is immovable and cannot get out. If desired, the push button can be provided with a needle tip and the coin with a hole, to prevent sliding. A catch prevents the push button from snapping back. Personnel can disengage the catch with an apparatus, for example a magnet, to release the garment. FIG. 18 shows the label from below. The opening is elliptical. FIG. 19 shows the cross section of the front side. It is noticeable that here the cloth is not buckled.

Figure 20:
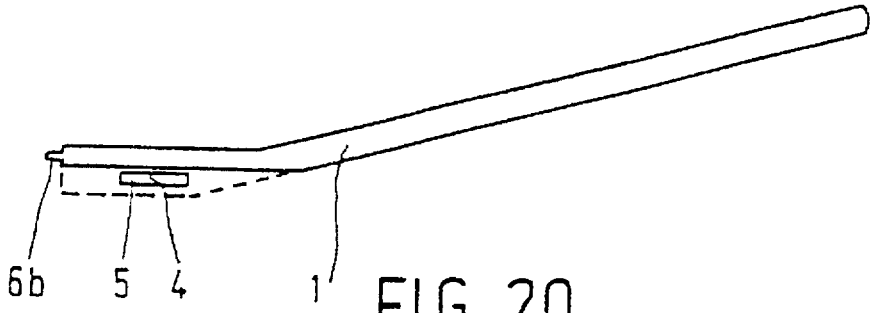
FIGS. 20 and 21 are cross sections of an embodiment in which it is noticeable that the label comprises one member and the cloth is folded double in the slit intended for that purpose.
Figure 21:
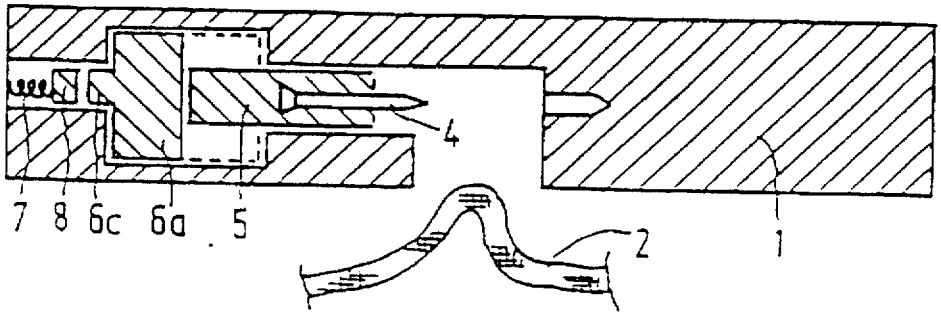
Figure 22:
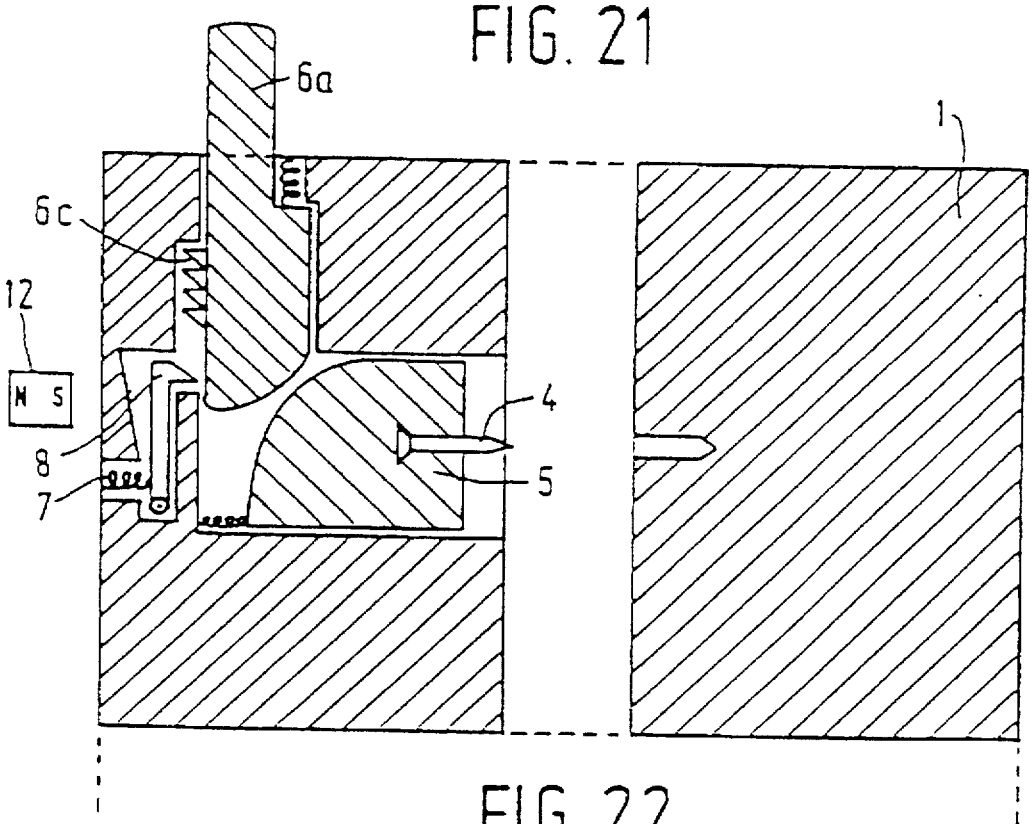
FIG. 22 is a cross section of the label in the plane of the label.
Figure 26:
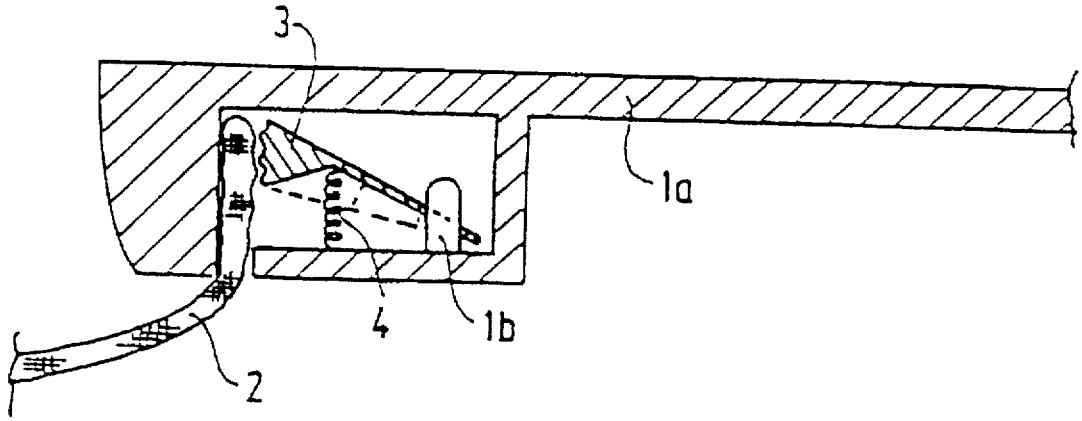
FIG. 26 is a longitudinal cross sectional view of a label in another embodiment.

FIG. 20 and FIG. 21 show a cross section of an embodiment in which it is noticeable that the label comprises one member and the cloth is folded double in the slit intended for that purpose. In the slit there is a support with a thin needle. FIG. 26 shows a cross section of the label in the plane of the label: outside the label a member protrudes which, when depressed, pushes the support against the cloth. The back of the support, i.e. the part contacting the protruding member, is oblique or has a parabolic form. This works as a lever; moreover, forces cannot bring the support in the unlocked position. A catch with a spring ensures that the protruding member cannot be pulled out and stays in place. Personnel can with a suitable magnet unlock the label disengaging the cloth. The label can be designed as desired with respect to the direction of the pleat. The embodiment of the figure will result in a pleat extending from the top to the bottom. This may be troublesome for very tight garments, so that in that case the head of the label must be turned over 90 degrees. In that particular embodiment the pleat extends horizontally, which is less splendid for a hanging presentation, but no problem for a lying presentation. Despite the disadvantage of the pleat, this is a label that does not damage the cloth and resists shoplifters. Optionally the label can be attached to the edge of the cloth.

Figure 23A:
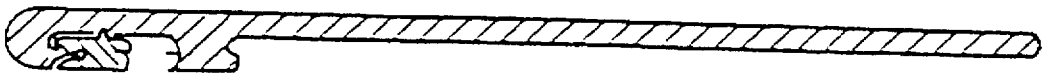
FIGS. 23*a* and 23*b* are cross sectional side views of another embodiment.
Figure 23B:
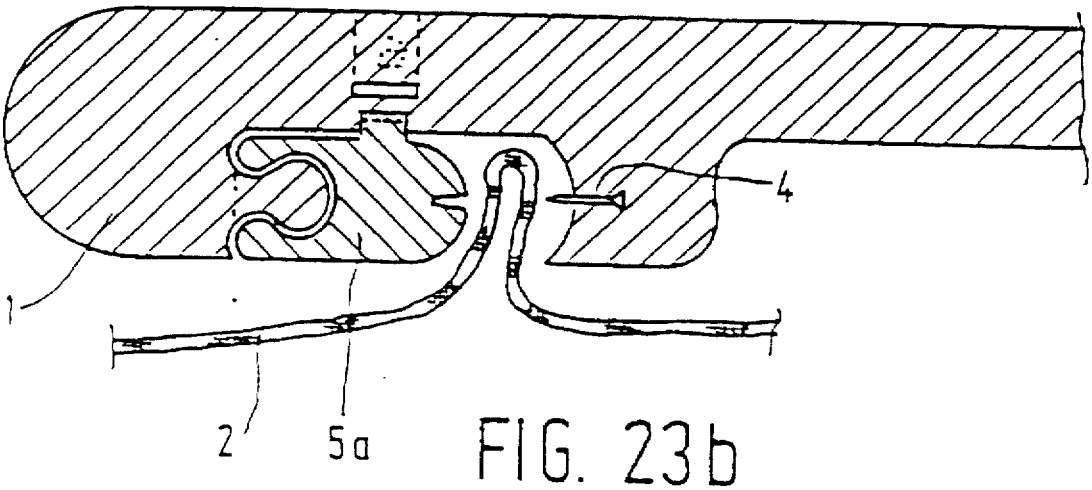
Figure 24:
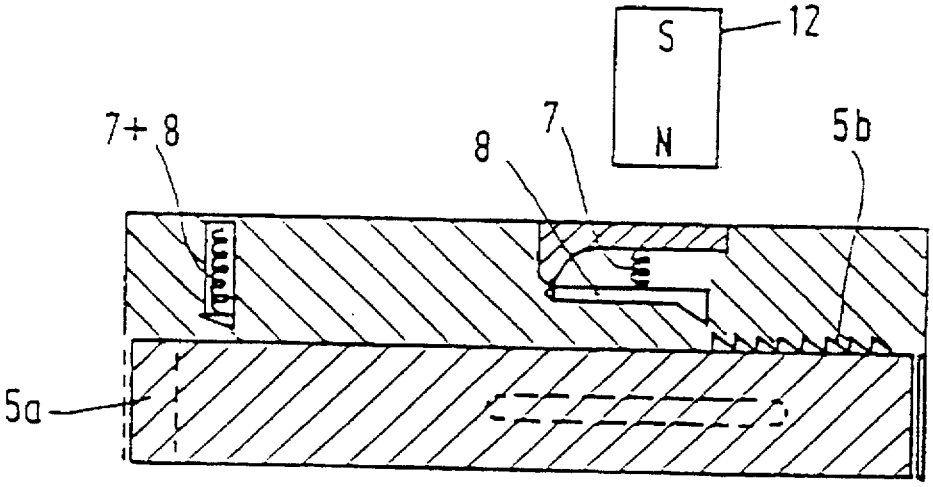
FIG. 24 is a sectional view of a catch and the indentations on the member.
Figure 25A:
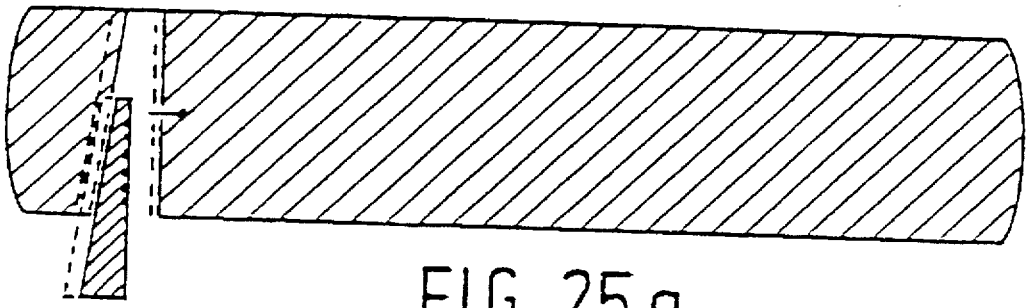
FIGS. 25*a* and 25*b* are top views in cross section of the label.
Figure 25B:
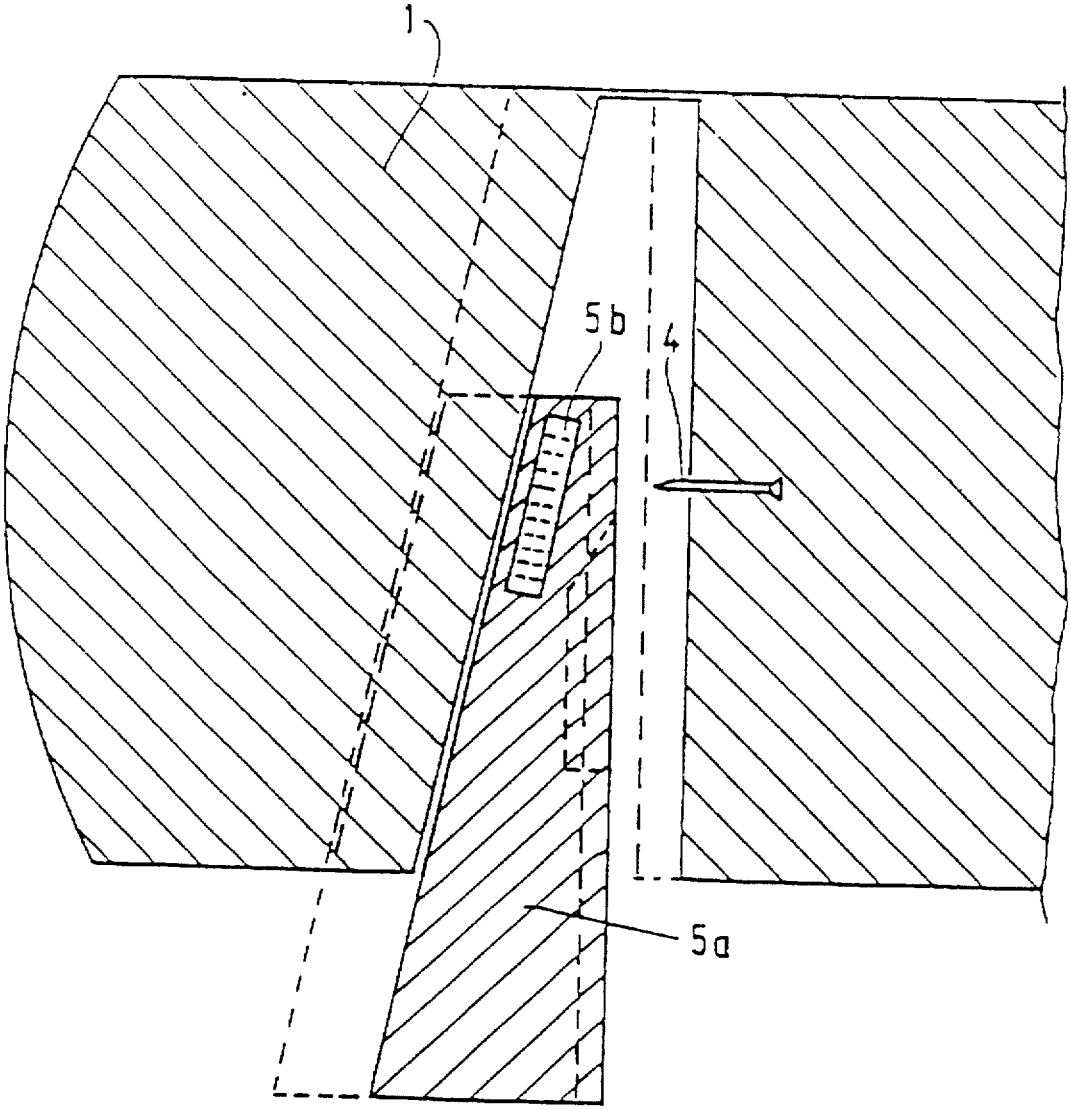

FIG. 23 and 23*b* show a cross sectional side view of an embodiment. In this embodiment the pleat is smaller because there is cloth in the label over a smaller depth. The member pressing against the cloth is also the member that protrudes and it can be pushed with the hand or finger in the label, and thus secures matters because this member cannot snap back. FIG. X show a catch and the indentations on the member. FIG. 25*a* and 25*b* shows a top view in cross section of the label. It is clear that when a thief would use a screwdriver to lever in the groove, he will not be able to exert an effective force.

Figure 27:
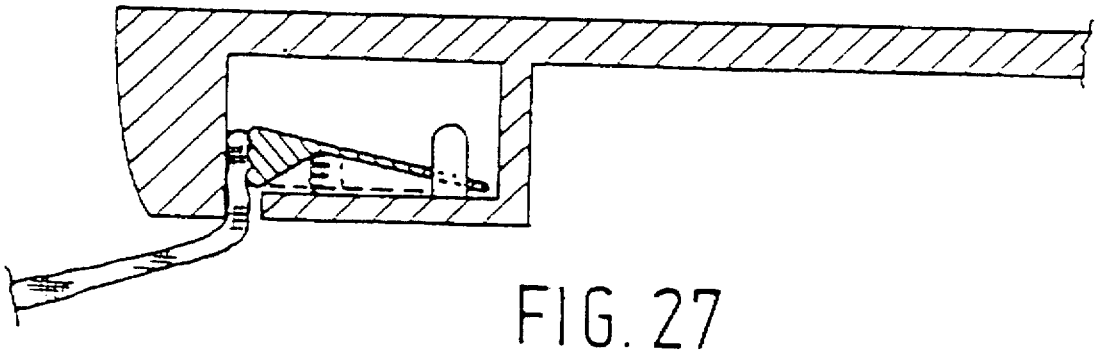
FIG. 27 is a view similar to FIG. 26 showing a jammed cloth.
Figure 28:
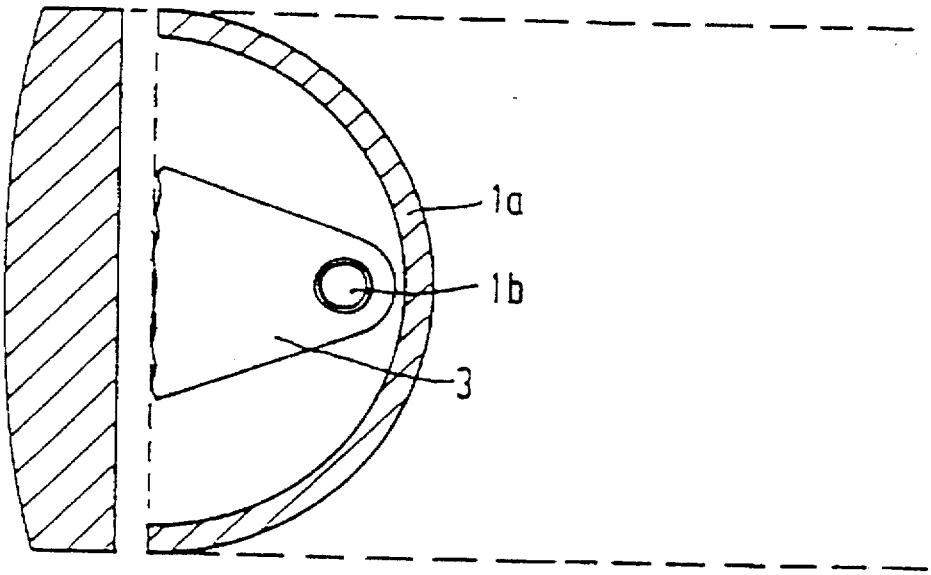
FIG. 28 is a view showing the label from above.

FIG. 26 shows a label in another embodiment in a longitudinal cross sectional view. The cloth is put singly or double in a groove behind which a member is provided. This member is wedge shaped and placed slightly oblique and is lightly indented on its short side, the tangent plane with the cloth. It is also provided with a spring attached to the label to clasp the cloth lightly. FIG. 27 if the shoplifter pulls at the cloth, then—due to the oblique position of a part of the cloth—it will as a consequence of the tensive force get jammed even more. FIG. 28 shows the label from above. If the shoplifter pulls in the direction of the slot, the member, which is also movable sideways, will clasp the cloth even stronger. The label can be unlocked by personnel with a magnet. The end of the member is provided with metal or a magnetic part after all.

Figure 29:
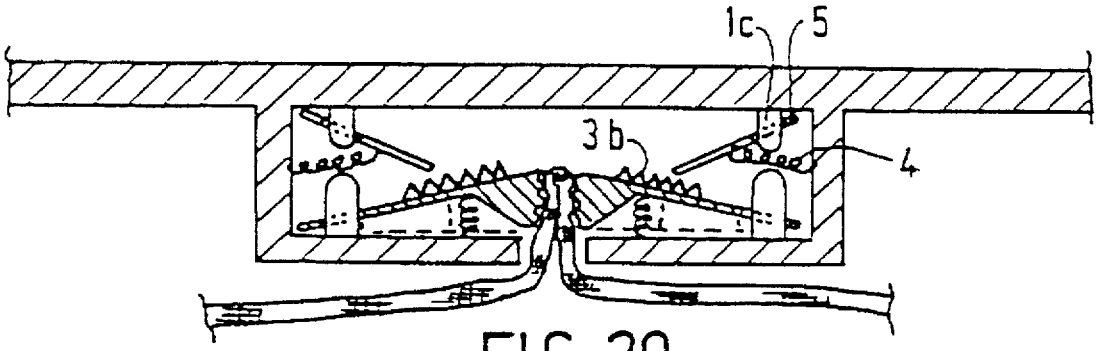
FIG. 29 is a sectional view showing the label equipped with two constructions opposite against each other.
Figure 30:
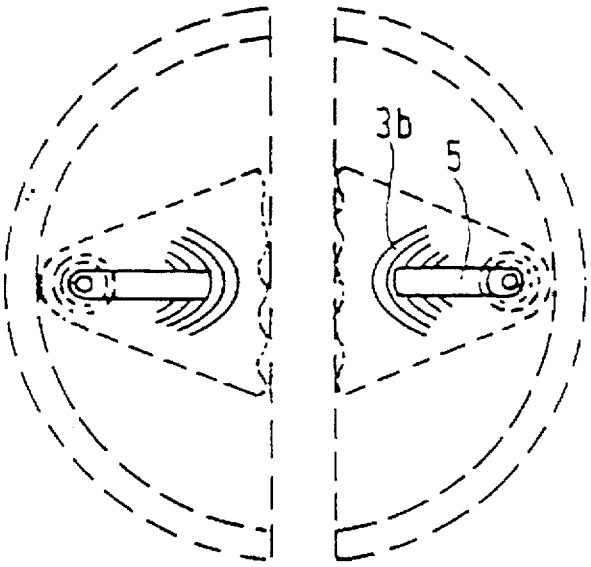
FIG. 30 is a plan view showing the label with the aforementioned indentations.

FIG. 29 shows the label equipped with two constructions opposite against each other, to resist even a larger tensive force. A smart shoplifter, however, might use a piece of cardboard to push the clasping member upward. To circumvent this disadvantage, the clasping members are indented at their upper side against which another obliquely oriented member rests, and is also pulled at by a small spring. These members as well unlock due to the use of the magnet by personnel. FIG. 30 shows the label with the afore-mentioned indentations tapering to a point, to let the members slide into each other in the right way.

Figure 31:
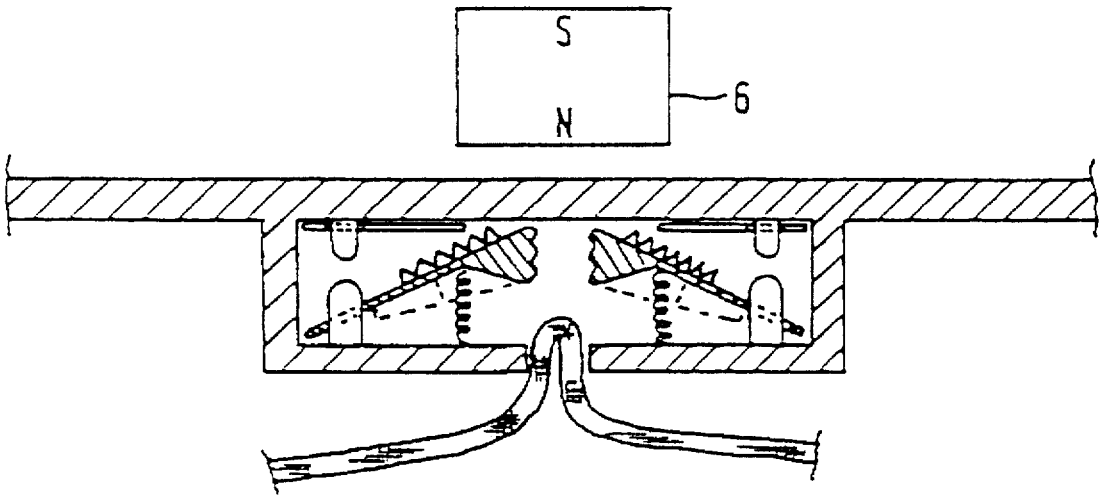
FIG. 31 is a view similar to FIG. 29 showing the label in the unlocked position.

FIG. 31 shows the label in the unlocked position. A strong electromagnet at the check-out, to be operated by personnel, is preferred. The label is balanced in such a way, that a shoplifter with a magnet cannot unlock the label.

The invention is not limited to the disclosed embodiments. Within the scope of the invention several variations are possible. In particular the right is reserved with respect to detectable elements to be built in, as well as passive security such as: indelible ink or corrosive acid.

Component designation belonging to the drawings

FIGS. 1 and 2: 1. Inner member. 2. Cloth. 3. Outer member. FIG. C, D: 1. Part of label. 2. Cloth. 3. Other part of label 4. Very thin needle. 5. Working part. (tongue). FIGS. 5 and 6: 1*a*. Thin section of stationary part. 1*b*. Thick section. 1*c*. Hole. 3. Second member of label. 4. Very thin needle. 5*a*. Section of working part (tongue) contacting the cloth. 5. Bridge to 5*c*. 5*c*. Section that catches in a slot. 6*a*. Thin section of rotatable ring with slot. 6*d*. Thick section. 7. Spring. 8. Catch. 9*a*. airgun. 9*b*. Projecting means. 9*c*. Holes. 9*d*. Switch. 10. Tubing. 11. Compressor. FIGS. 7 and 8: 1. Member of label. 2. Cloth. 3 Other member of label. 4. Sturdy needle. 5. Working part. FIGS. 9, 10 and 11 1. Inner member of label. 1*a*. Thin section. 1*b*. Thick section. 1*c*. Indentations. 2. Cloth. 3. Outer member. 4. Very thin needle. 5. Working part. 6. Wedge-shaped part. 6*a*. Part that stays within the label. 6*b*. Part that projects in disengaged position. 7. Spring. 8*a*. Magnetic catch. 8*b*. Hinge+mounting. 12. Magnet. FIGS. 12, 13, 14 and 15. 1*a*. Wedge-shaped part of label. 1*b*. Bulge. 1*c*. Serrated edge. 2. Cloth. 3. Wedge-shaped outer member. 4. Very thin needle. 7. Spring. 8. Depressible catch. 12. Magnet. FIG. 16. 2. Garment. 3. Attached label. 13. Chain. 14. Securing. FIGS. 17, 18 and 19. 1. Coin-shaped part. 2. Cloth. 3. Label. 4. Very thin needle. 5. Pushing part, may be wedge-shaped. 7. Spring. 8. Catch. FIGS. 20, 21 and 26. 1. Label. 2. Cloth. 4. Thin needle. 5. Wedge shaped part. 6. Part with wedge-shaped tangent plane. 6*b*. Indentations. 6*c*. Projecting section. 7. Spring. 12. Magnet.

FIGS. 23, 23*b*, 24, 25*a* and 25*b*. 1. Label. 2. Cloth. 4. Very thin needle. 3*a*. Wedge-shaped part. 5*b*. Indentations. 7. Spring. 8. Catch. 12. Magnet. FIGS. 26, 27 and 28. 1*a*. Label. 1*b*. Rod-shaped projection. 2.5 Cloth. 3. Lightly indented pushing part. 4. Spring. FIGS. 29, 30 and 31. 1*c*. Rod-shaped projection. 3*b*. Indentations on pushing part. 4. Spring. 5. Locked part. 6. Magnet.

Figure 32A:
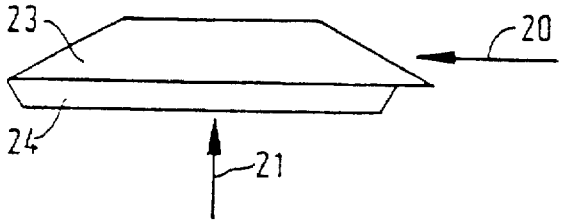
FIG. 32*a* is a side view of the member of the device.

A further embodiment of the invention is elucidated by FIG. 32*a*–32 *g*.

Figure 32B:
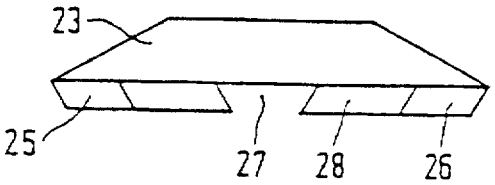
FIG. 32*c* is a view of the member according to arrow 21 of FIG. 32*a.;*
FIG. 32*d* is a cross sectional view according to line D—D of FIG. 32*c;*
FIG. 32*e* is an elevational view of the substantially flat part.
FIG. 32*f* a view of the part according to arrow 22 of FIG. 32*e;*
FIG. 32*g* a cross sectional view according to line G—G of FIG. 32*e*.

FIG. 32*a* is a side view of the member of the device;

FIG. 32*b* is a view of the member according to arrow 20 of FIG. 32*a;*

Figure 32C:
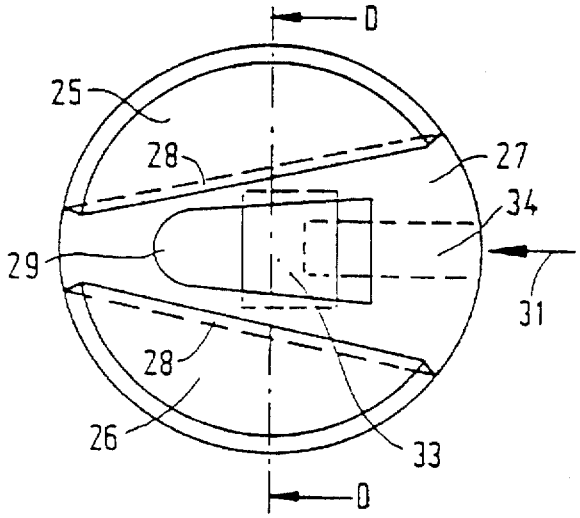

FIG. 32*c* is a view of the member according to arrow 21 of FIG. 32*a;*

Figure 32E:
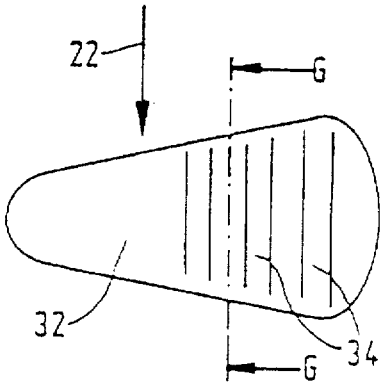
Figure 32F:
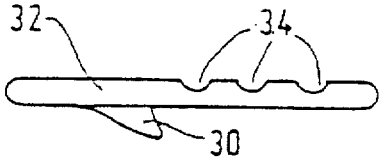
Figure 32D:
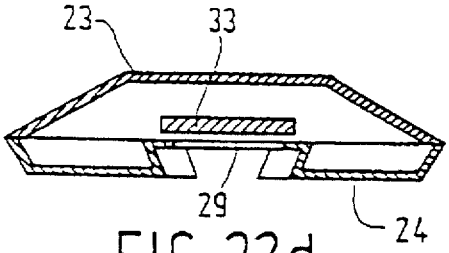

FIG. 32*d* is a cross sectional view according to line D—D of FIG. 32*c;*

FIG. 32*e* is a view of the substantially flat part;

FIG. 32*f* is a view of the part according to arrow 22 of FIG. 32*e;*

Figure 32G:
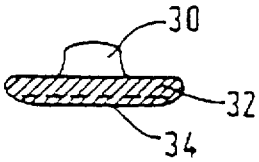

FIG. 32*g* is a cross sectional view according to line GG of FIG. 32*e*.

The member has an upper side 23 and a lower side 24. The lower side 24 is provided with two projecting segments 25 and 26 defining a wedge shaped recess 27. The edges 28 of the segments 25 of 26, forming the wedge shape, are undercut in such a way that it forms a concave surface which can clasp the substantially flat part as is shown in FIGS. 32*e*, 32*f* and 32*g*.

The lower side of the member, between the two projecting segments 25 and 26 is provided with a hole 29 in which protrusion 30 of the substantially flat part can reach. Arrow 31 shows how Bart 32 of FIG. 32*e* can slide in the member as shown in FIG. 32*c*.

A catching means 33 is shown in the hole 29 (FIG. 1C). This catching means 33 is a metal element which is connected to the member by a resilient strip 34, so that the said element is urged downwardly by the resilient strip 34. When the substantially flat part 32 is shifted in the recess 27 of the member according to arrow 31, the protrusion 30 will lift the metal element 33. After the part is shifted into the recess 27 to be fixed by the undercut of edges 28, the resilient strip 34 will urge metal element 33 back into its original position, so that it catches protrusion 30 and the part is blocked in the member. A flexible layer of material, for example a piece of cloth, can be inserted between the part 32 and the member, so that the device is attached to the layer of material.

The part 32 is provided with recesses 34 to provide for an antiskid surface to facilitate operation by a finger.

Part 32 can be made stiff, so that it cannot be removed by a screwdriver or so.

Metal element 33 can be lifted by a special magnet to remove the device from the layer of material. Element 33 may also be lifted by other known means, in that case it can be made of other material than metal. Of course, other means for clasping the substantially flat part in the member can be used in a similar way.

The device can be provided with any detectable means, which is not shown in FIG. 1A–1G.

I claim:

1. A device for temporary attachment to goods having flexible material for the protection thereof against theft, comprising:

a member having a side with a recess formed therein, said recess having a given shape, and said recess being bounded laterally by undercut side walls;

a part having a shape substantially complementary to said recess of said member and being adapted to be inserted in said recess;

said recess of said member and said part defining a space therebetween for receiving and clamping a layer of flexible material of the goods to be protected against theft without penetrating through the flexible material;

a protrusion formed on said part and said recess having a plurality of indentations formed therein; and said protrusion on said part releasably locking with said plurality of indentations in said recess of said member with the layer of material clasped in between.

2. The device according to claim 1, wherein said member has a flat side, said part is a substantially flat part, said given shape of said recess is a wedge shape as seen parallel to said flat side, and said flat part is adapted to be slidably inserted in said recess.

3. A device for temporary attachment to flexible goods for the protection thereof against theft, comprising:

a member defining a cavity for receiving therein flexible material of the goods to be protected against theft;

a swivellably disposed jaw having serrations on a flexible material contacting surface thereof disposed in said cavity for locking said flexible material in said cavity without penetrating through the flexible material, said swivellably disposed jaw providing an increasing locking force on the flexible material proportionally to a force with which the flexible material is pulled out of the cavity.

4. The device according to claim 3, including a spring biassing said jaw into a locking position in which said jaw clamps the flexible material in said cavity.

5. The device according to claim 3, wherein said swivellably disposed jaw is formed of magnetic material and the flexible material can be released from said swivellably disposed jaw by a magnet applied externally of said member.

6. The device according to claim 3, including a chain attached at said member for fastening the device to a building structure.

7. A device for temporary attachment to flexible goods for the protection thereof against theft, comprising:

a member defining a cavity for receiving therein flexible material of the goods to be protected against theft;

two swivellably disposed mutually opposite jaws disposed in said cavity for locking said flexible material in said cavity without penetrating through the flexible material, said two swivellably disposed jaws providing an increasing locking force on the flexible material proportionally to a force with which the flexible material is pulled out of the cavity.

* * * * *